United States Patent [19]

Marton

[11] 4,058,936

[45] Nov. 22, 1977

[54] VACUUM SANDER

[76] Inventor: Miksa Marton, R.R. No. 1, Old Castle, Windsor, Ontario, Canada

[21] Appl. No.: 650,729

[22] Filed: Jan. 20, 1976

[51] Int. Cl.[2] ..... B24B 23/00

[52] U.S. Cl. ..... 51/170 T; 51/381

[58] Field of Search ..... 51/170 T, 275, 379, 51/356, 380, 383, 381, 382, 273; 15/385

[56] References Cited

U.S. PATENT DOCUMENTS

| | | | |
|---|---|---|---|
| 407,246 | 7/1889 | Rogers | 51/379 |
| 523,594 | 7/1894 | Rogers | 51/379 |
| 1,800,341 | 4/1931 | Davies | 15/385 |
| 2,000,930 | 5/1935 | De Nagy | 15/385 |
| 2,588,000 | 3/1952 | Hines | 15/385 |
| 3,189,930 | 6/1965 | Tuthill | 15/385 |
| 3,378,961 | 4/1968 | Marton | 51/275 |
| 3,722,147 | 3/1973 | Brenner | 51/170 T |
| 3,932,966 | 1/1976 | Stern | 51/356 |

*Primary Examiner*—James L. Jones, Jr.
*Attorney, Agent, or Firm*—Burns, Doane, Swecker & Mathis

[57] ABSTRACT

This invention is directed to a vacuum sanding device. More particularly, the invention is directed to a vacuum sanding device that has one or more vacuum openings in the central area of the sanding disc, or, one or more vacuum openings located around the periphery of the sanding disc, or a combination of one or more openings in the central area of the sanding disc and one or more openings located around the periphery of the sanding disc.

15 Claims, 22 Drawing Figures

VACUUM SANDER

BACKGROUND OF THE INVENTION

Sanding devices are widely used in a wide variety of manufacturing operations. For example, in the automobile manufacturing industry, sanding systems are used to prepare the metal surface of the car body for receiving one or more coats of paint primer, and one or more finishing coats of paint. Frequently, one or more of the intermediate layers of paint must be sanded or touched up by sanding in order to smooth rough edges and other imperfections in the finish before the final coat of paint is applied.

Sanding is a necessary procedure in providing a smooth surface to the finished article and is therefore virtually indispensable. However, there has been a perennial problem associated with any sanding operation, and even more so with sanding operations that are conducted using high speed mechanical equipment. The material that is sanded away from the surface being prepared is given off in the form of a fine dust. Frequently, this dust is so light that it hangs in the air for a period of time before settling.

In large scale sanding operations, using high speed mechanical equipment, a large quantity of fine dust is generated which creates very uncomfortable working conditions for the workmen. The fine dust floats in the air for a considerable amount of time and is breathed in by the workmen, settles on their clothing, and all exposed surfaces surrounding the sanding operation. The dust is therefore an acute nuisance.

Many attempts in the past have been made to reduce the dusting problem associated with high speed, large scale sanding operations. One method of reducing the dusting problem, particularly in automobile manufacturing plants, is to continuously bathe the working surface with a moving film of water that carries away the fine material that has been abraded away by the sanding machine. This is known as "wet sanding". However, this system, while it keeps dusting to a minimum, uses considerable quantities of water, and makes working conditions uncomfortable for the workmen. The workmen must wear waterproof clothing, and the generally wet conditions throughout the sanding plant create a cold and uncomfortable environment.

It would be preferably if a "dry sanding" system, which did not have a dusting problem, could be devised. Efforts in this direction have been made by attempting to suck the dust out of the air by means of a vacuum system. However, these efforts to date have been only marginally successful. It has been possible to draw away only a small proportion of the dust by using the systems designed to date. Considerable dust remains in the air and is inhaled by the workmen and settles on the workpiece as well as surrounding objects.

A further problem associated with "dry sanding" metal and plastic objects is that the abraded materials develops an electrostatic charge which causes the dust to adhere to the surface of the workpiece being sanded. Vacuum systems designed to date have been unsuccessful in removing the dust that clings electrostatically to the surface of the workpiece.

To alleviate the foregoing problems associated with "dry sanding", I have previously developed a vacuum sanding system that is very effective in drawing away the dust developed by the sanding machine. My system is disclosed and claimed in copending Canadian patent application Ser. No. 148,535, filed Aug. 2, 1972. The system disclosed uses a vacuum chamber that encloses the sanding pad and sanding disc. The chamber has a plurality of openings that are distributed about the periphery of the circular sanding disc of the sanding device. This system has the advantage of placing the vacuum opening very close to the area of the workpiece where the material is being abraded free of the workpiece, and, as a consequence, almost no dust escapes being drawn away by one of the vacuum openings.

However, while very efficient, this vacuum system has two disadvantages. The vacuum housing obscures the sanding disc and backup pad from view by the workman. As a result, the workman doing the sanding is not able to see the edge of the sanding disc as it sands away the material from the workpiece. A considerable amount of sanding is done on special areas, using only one side of the sanding disc, and in order to sand these areas smoothly, the workman prefers to be able to see the surface as it is being sanded. This not possible with the vacuum chamber system since it encloses and hides the sanding disc.

The second disadvantage is that the vacuum chamber surrounding the sanding disc acts as a bumper of sorts and prevents the sanding disc from running up to the extreme edge of any workpiece that has an upraised border to obstruction on it. In such situations, it is necessary to sand the unsanded border areas using a sanding device that does not have a vacuum chamber surrounding the sanding dics. This is a nuisance, is time consuming and generates a certain amount of dust that coats the other area of the workpiece.

SUMMARY OF THE INVENTION

To overcome the foregoing problems, I have invented a sanding machine that enables a vacuum to be drawn directly on the surface of the workpiece, at the location where the workpiece is being sanded, through the sanding disc and backup pad while they are being rapidly rotated to provide sanding action on the workpiece. This is done by having a suction housing positioned above the backup pad with the suction housing communicating with one or more suction openings built into the backup pad of the sanding disc. An air tight seal betwen the suction housing and the backup pad prevents casual air being drawn into the suction system. One or more openings are located in the central area of the backup pad and these opening(s) communicate with corresponding openings in the sanding disc. Alternatively, or in combination with the centre opening(s), one or more openings are located around the periphery of the backup pad either in the sides of the backup pad or in the bottom periphery communicating with openings in the periphery of the sanding disc. The most efficient results are obtained by positioning suction openings in both the centre area and the peripheral area of the backup pad, especially for smaller sizes of backup pad and sanding disc. Centre opening only are more suitable for larger sizes of backup pad and sanding disc. However, peripheral openings alone can also be effective. A vacuum is drawn on the opening(s) by means of the suction housing which is located between the backup pad and the motor driving the backup pad and the sanding disc. The combination of the suction housing, backup pad and sanding disc acts as an overall suction system communicating directly from the surface of the workpiece to the vacuum source.

The advantage of my system is that the vacuum openings located in the backup pad pinpoint the suction action directly on the workpiece and effectively draw away substantially all material that is abraded free from the workpiece surface. I suspect that the reason for the startling success caused by having the openings located in the backup pad and in the sanding disc can be explained by the following circumstances. Commercially available sanders are usually air driven, and impart not only a rotation movement to the sanding disc, but also a vibration movement. As the snading disc is rotated and vibrated, the vibration action causes the sanding disc to jump a slight distance away from the workpiece for a very short period of time many times each second. While I do not wish to be limited to any theories that are expressed, it seems that the particles that are abraded free from the workpiece are able to migrate outwardly or inwardly while the sanding disc is momentarily a short distance away from the workpiece during one of the vibration cycles, and hence virtually all particles worked free by the sanding disc are caught by the air currents that are created by the suction openings in the sanding disc and backup pad combination and are thereby sucked into one of the openings.

I have found that my sanding system is so effective that even the particles that are held onto the surface of the workpiece by electrostatic attraction, are almost completely removed. This is of considerable advantage in commercial sanding operations because no subsequent dusting of any consequence must be done to the surface of the workpiece in order to prepare it for other operations such as painting. The system is locating suction openings in the centre area and the periphery of the sanding disc is particularly effective in removing the particles that cling to the surface of the workpiece by electrostatic attraction.

My sanding system has another advantage in that the suction action created by having centre suction openings tends to hold the sanding disc against the surface of the workpiece. This minimizes the pressure that must be applied by the workman in order to keep the sanding disc against the surface of the workpiece. The holding action is particularly advantageous in situations where the sanding device must be held over head. No holding action is present when there are only peripheral suction openings in the backup pad. There is reduced holding action when both centre and peripheral suction openings are present.

In larger models of my sanding apparatus, when only central suction openings are present, the suction action holding the sander to the workpiece is so strong that it is virtually impossible for the workman to move the sanding disc about the surface of the workpiece. To enable the larger models of sander having only central suction openings to move about the workpiece surface easily, it is necessary to incorporate an adjustable suction control valve in the suction housing. This suction control valve, by being adjustable, permits the workman to adjust the degree of vacuum that is being drawn on the sanding pad. Using the adjustable suction control valve, the workman can strike a balance between the degree of suction force which holds the sanding disc against the surface of the workpiece and the suction force required for efficient dust removal, thereby permitting the workman to move the disc freely about the surface of the workpiece, while at the same time obtaining good vacuum action and efficient dust removal.

Another advantage of my sanding system is that the sandpaper lasts much longer than normal. This might be due to the fact that when the material sanded free from the workpiece is permitted to remain on the surface of the workpiece without being immediately removed, the sandpaper continues to cut the loose material, as well as cutting free new material from the workpiece. Hence some of the cutting action of the abrasive particles on the sandpaper is wasted by recutting particles that have already been cut free from the surface of the workpiece. Moreover, when the particles are allowed to remain on the surface of the workpiece the spaces between each of the abrasive particles on the sandpaper tend to become clogged thereby causing a reduction in cutting efficiency.

Another advantage of my sanding system is that I have found that the contant drawing of air through the various suction holes, and under the sanding disc, keeps the sanding disc, the backup pad, and the bearings of the sanding machine cool. Thus the life of the sanding disc, the backup pad and the bearings of the sander is prolonged. Furthermore, it is possible with the cooler sanding disc, to continue to sand for long periods of time, without having to stop periodically because of heat buildup in the sandpaper and the backup pad. Accordingly, greater production per workman is possible.

The backup pad with the central suction openings, or the peripheral suction openings, or the central and peripheral suction openings in combination, can be used in association with a special adaptation of my flexible material backed sand disc system, which is the subject of pending Canadian patent application Ser. No. 203,840, filed July 2, 1974. The flexible backing material can be any suitable flexible material that stands up to the use. I have found that linen is particularly suitable as the flexible material. To adapt the linen backed sandpaper disc to the backup pad having the central, peripheral, or both central and peripheral suction openings, it is necessary to position one or more openings, if applicable, in the central area of the sanding disc, that correspond to the opening(s), if any in the backup pad, and, if applicable, a second set of openings in the linen border surrounding the sanding disc or in the periphery of the sanding disc. When the linen and sanding disc are fastened to the backup pad, any central opening correspond with any openings in the central part of the backup pad, and any peripheral openings in the linen skirt or the periphery of the sanding disc correspond with any openings in the periphery of the backup pad. Accordingly, full and efficient suction action is not interfered with by mounting the sanding pad and the linen skirt on the backup pad.

The sanding disc and the peripheral linen skirt are secured to the backup pad by means of elastic O-ring which fits into a groove located around the circumference of the backup pad. the O-ring rides over the linen skirt and thereby holds it securely to all sides of the backup pad.

The central suction openings in the sanding disc, when present, may be either a plurality of suction holes corresponding with and located in the same location as the plurality of holes in the backup pad, or the centre of the sanding disc may be one large circular hole which exposes all openings in the centre of the backup pad and permits full suction to be drawn on those central openings. I have found that either a plurality of central holes in the sanding disc, or a single central opening in the sanding disc, works equally well in my invention.

Similarly, the openings in the peripheral linen skirt, or in the periphery of the sanding disc may be either round openings that correspond with and fit over any openings located in the periphery of the backup pad, or slots that extend radially from the centre of the sanding disc, commencing at or close to the edge of the sanding disc, and extending to the circumference of the linen skirt. In the latter case, the sanding disc has a somewhat star-like appearance. Again, any of these embodiments is satisfactory, so long as nothing obstructs the suction action of the peripheral suction openings in the backup pad.

One advantage in having a single circular central opening in the sanding disc is that a circular sandpaper disc of the same size as the centre opening is yielded. The centre disc can be used as smaller sanding discs for smaller models of sanders. This minimizes wastage, and maximizes profitability. The sandpaper disc market is largely standardized, and sanding discs tend to be produced in even inch increments such as, for example, three inch, four inch, five inch, and so on. Thus a single central opening of standard size in a larger size disc yields a central disc of standard size correponding to the size of centre opening in the larger disc.

I have found that the part of the sanding disc that does the most work tends to be the outer portion, and not the inner portion of the circular disc. Perhaps this is due to the fact that the outer portions of the sanding disc reach the new work more frequently, and also because the workman tends to do special jobs using one edge of the backup pad. Therefore, punching out the central area of the sanding disc, in my experience, has not materially reduced the efficiency of the sanding disc.

To illustrate, it is possible with an 8 inch sanding disc to punch out a 5 inch diameter disc from the centre, thereby leaving an annular sanding area of 1½ inches in width on each side of the sanding disc. I have found that this is sufficient width to enable the 8 inch sander to be very effective and efficient. The 5 inch circular centre piece of the sandpaper can then be used to manufacture a 5 inch sanding disc. In selecting the number and size of openings in the centre of the sanding disc it is always necessary, of course, to ensure that there is sufficient sanding disc area to provide efficient sanding action, and a sufficient amount of peripheral linen skirt to lend strength to the overall central disc and peripheral linen skirt combination. The sanding disc then remains snuggly secured to the backup pad and is able to withstand the high speeds of rotation imparted to the central sanding disc and the linen skirt by the sander.

The centre disc cut out from the larger sandpaper disc can be adapted to fit smaller sizes of backup pad, such as a 3 inch backup pad and disc, which combination is widely used for touch up and finishing work. For the purposes of this discussion, the 3 inch backup pad will be discussed although it will be recognized that other sizes are possible. The centre disc cut from the larger disc is patterned by using a die, or the like to have a 3 inch centre portion with a plurality of projections extending radially around the centre portion. The radially extending projections have grit thereon, the same as the centre portion. The centre portion and the projections are both backed with a resilient material such as linen which makes the centre disc and the projections resistant to tearing. The centre disc and the projections are fitted to the 3 inch backup pad by centering the centre portion on the backup pad and folding the projections upwardly around the sides of the backup pad. An O-ring is then slipped over the projections securing them against the sides of the backup pad. I have found that having grit on the projections enables the O-ring to apply a better grip to the projections and thereby hold the sandpaper disc more securely to the backup pad.

With an 8 inch backup pad, I have found that it is advantageous to position any peripheral suction openings in the backup pad not in a radial direction, but rather in a direction which gives a "pin-wheel" orientation to the peripheral suction openings, when the 8 inch backup pad is viewed either from above or below. The "pin-wheel" oriented peripheral suction openings take advantage of the rotational action of the backup pad, when it is in operation, and consequently a certain amount of the rotational action is used in assisting the suction action through the peripheral suction openings. The peripheral suction openings are slanted in the direction of rotation of the backup pad. If the peripheral suction openings are slanted in the opposite direction, then probably the suction action would not be as effective. The centre suction openings and the peripheral suction openings are connected to that they join together at common openings located in a central area at the back of the backup pad. With the 8 inch sander, it is less cumbersome to use a smaller suction housing and hence it is perferable that the suction housing does not extend to the outer boundaries of the 8 inch backup pad.

One advantage of my central sanding disc, and linen peripheral skirt system, is that it is not necessary in order to apply a fresh sanding disc to the backup pad to handle messy glues, which tend to collect in the vacuum openings, and eventually clog or reduce the efficiency of the suction action of the openings. However, it will be recognized that while the central sanding disc and peripheral linen skirt are preferred, it is possible to use my backup pad with the central and peripheral suction openings either singly or in combination with a central sanding disc that glues to the backup pad. Then, when a new disc must be applied, the used worn out disc is peeled from the back of the pad and the new disc is applied by applying a fresh coat of glue to the backup pad. However, care must be taken to ensure that the central suction openings remain clear.

The dimensions of the central opening, or the position of the central suction holes, cannot be chosen at random. It is necessary to ensure that the dimensions of the central opening and the positions of the plurality of central suction holes, are such that efficient vacuum action at the centre of the sanding disc, is obtained. If the holes are located too close to the centre of the sanding disc, the suction action and the ability of the sander to withdraw dust from the area of the workpiece, is reduced. Similarly, the centre hole must not be so large that it reduces the amount of sanding surface of the sanding disc to a point where efficient sanding cannot be achieved. If a plurality of holes is being used in a circular pattern in the central area of the sanding disc, care must be taken to ensure that they are not located too close to the periphery of the sanding disc. If this occurs, then a "dead spot" tends to form in the centre area of the disc and the suction efficiency at the centre of the disc is not maximized.

Installing the central sandpaper disc and the peripheral linen skirt combination on the backup pad can be facilitated using a loading apparatus that is adapted to hold the sandpaper disc, the backup pad and the elastic O-ring in proper orientation. The advantage of the loading device is that it lines up the holes in the central sanding disc, and the peripheral linen skirt, with the corresponding openings in the backup pad of the sander, and permits the elastic O-ring to be easily snapped over the linen skirt into a circumferential groove in the side of the backup pad. Of course, the centre sanding disc and the peripheral linen skirt together with the elastic O-ring can be secured to the backup pad by manual means, but it is not as convenient.

The backup pad is constructed by using a circular disc that is composed of a spongy flexible material in combination with a slightly flexible reinforcing backup disc of approximately the same diameter as the sponge-like frontal disc. It is advantageous to have the reinforcing disc constructed of a slightly flexible material because this assists the operator in using the edges of the sanding pad in specialized sanding operations. The semi-rigid nature of the reinforcing disc enables the workman to apply pressure to the edge of the backup pad.

The suction housing can extend to the edges of the backup pad, thereby covering the suction openings that are located in the centre as well as the periphery of the backup pad. However, it is convenient to have the suction housing of minimum size because it is less bulky. Accordingly, a slightly flexible backup pad cover can be used, especially for the smaller sizes of backup pad. The backup pad cover encloses the suction openings in the backup pad and co-operates with the smaller suction housing so that the vacuum action is transmitted directly from the suction housing to the backup pad openings. This backup pad cover is also constructed of a slightly flexible material, so that is will co-operate with the reinforcing disc and bend slightly when a pressure is applied by the operator to the edge of the backup pad.

For long life, and trouble free operation, I have found that the reinforcing disc and the backup pad cover can be made of a tough plastic sold under the trade mark "NYLON". The sponge-like frontal pad can be constructed of sponge rubber, flexible or semi-flexible polyurethane foam, or some other suitable material. The combination of the sponge-like frontal pad and the slightly flexible reinforcing disc and backup pad cover provides a versatile backup pad for the sander.

The peripheral suction openings located in the side or the peripheral underside of the sponge-like frontal pad are drilled radially and extend upwardly so that they communicate with the top surface of the reinforcing disc. The peripheral suction openings may be located in the sides of the backup pad or under the peripheral edges of the backup pad. The central suction openings are drilled more or less vertically in the central area of the sponge-like frontal pad and communicate with the top surface of the reinforcing disc. The backup pad cover, when present, also has a plurality of suction holes drilled in a circular pattern approximately half the distance between the centre and the circumference of the circular pad cover. The circular backup pad cover mounted on the reinforcing disc creates a vacuum chamber at the back of the reinforcing disc, which in combination with the suction housing enables a suction to be imparted to the suction openings in the backup pad.

The reinforcing disc for the backup pad can be constructed according to the variety of shapes to adapt the backup pad for various needs. However, in constructing the reinforcing disc, it is necessary to ensure that the shape of the reinforcing disc permits adequate suction to be drawn on both the peripheral openings in the reinforcing disc as well as the central openings in the reinforcing disc, when both types of opening are present. In turn, these two sets of openings must communicate with the suction openings in the backup pad cover.

The suction housing that is located between the backup pad and the sander motor should be of a generally rigid construction to withstand the vacuum action and general abuse. The housing can be constructed of steel, rigid plastic, or the like. I have found that a semi-rigid plastic sold under the trade mark NYLON is very satisfactory, because the plastic is durable and light in weight. Lightness increases the handiness of the overall sanding apparatus.

The suction housing has a basic bell-like shape, with a suction outlet mounted on one side thereof. Of course, if it is considered to be suitable, a plurality of suction outlets can be connected to the suction housing. Usually, one suction outlet is sufficient. The suction outlet is connected to a vacuum source. When a vacuum is drawn on the suction outlet, the vacuum action is imparted by the suction housing to the suction openings in the backup pad and hence to the surface of the workpiece.

Since the backup pad reinforcing disc, and the backup pad cover, when present, are constructed of slightly flexible materials, there is a tendency when the backup pad and the backup pad cover are flexed, for an opening to appear where the suction housing meets the backup pad, or backup cover. To prevent the entry of casual air into the suction housing, which would reduce the overall vacuum efficiency of the sanding system, I have found it is advantageous to put a flexible elastic band around the periphery of the suction housing at the point where it meets the backup pad. This elastic band flexes with the backup pad cover, and provides a snug fit at all times regardless of which direction the backup pad is flexed, and provides a good suction seal even when the backup pad is rotating very rapidly. Of course, any other suitable method of sealing off the entry of casual air into the suction housing while the backup pad and sanding disc are rotating would also be satisfactory.

Located at the centre of the reinforcing disc at the back thereof is an upright extending bolt which is threaded to fit into a similarly threaded opening in the drive shaft of the motor driving the sander. The thread of the bolt is of a hand that causes the bolt to tighten, rather than loosen, when the motor is turned on, and the backup pad is rotating at a rapid speed. If the hand of the thread is in the opposite direction, the threaded bolt in the backup pad could become disengaged from the sander motor and the backup pad could fly loose, which would be dangerous.

The invention is directed to a backup pad for use with a sander that has one or more central suction opening(s) therein that permit a suction to be drawn at the central area of the working surface of the backup pad proximate to the workpiece being sanded.

The backup pad can include one or more suction opening(s) located in the periphery of the backup pad which opening(s) permit a suction to be drawn at the periphery of the backup pad proximate to the workpiece being sanded in addition to the suction being drawn at the central surface of the backup pad. Alternatively, the backup pad has one or more peripheral suction opening(s) that permit a suction to be drawn at the periphery of the backup pad proximate to the workpiece being sanded.

The backup pad can have at least two central suction openings, or two peripheral suction openings, or at least two central suction openings and at least two peripheral suction openings.

The invention includes for use in a sander which has a rotating sanding means for sanding the surface of a workpiece, the improvement comprising including in the sander means for enabling a suction to be applied to the surface of the workpiece through the rotating sanding means while the surface is being sanded by the rotating sanding means. The suction can be applied to the surface of the workpiece through one or more openings located in the rotating sanding means. The sander can include a suction housing that communicates with the one or more openings located in the rotating sanding means without permitting significant casual air to enter the suction system.

The invention includes a sanding machine which comprises (a) a sander motor, (b) a backup pad, (c) a sanding surface, and (d) a suction housing that is connected to a vacuum source and draws a suction at the interior of the sanding surface, or at the periphery of the sanding surface, or at both the interior and the periphery of the sanding surface.

The invention includes a backup pad and sanding surface combination for use in sanding a workpiece which comprises a suction opening located in the centre area of the sanding surface and a similar suction opening located in the centre area of the backup pad connecting the side of the backup pad that is adjacent the sanding surface with the opposite side of the backup pad. The backup pad and sanding surface combination can include a suction opening located in the peripheral area of the backup pad connecting the peripheral area of the backup pad proximate to the peripheral region of the sanding surface with the side of the backup pad opposite the side adjacent to the sanding surface. The backup pad can also be constructed so that the suction opening is located only in the peripheral area of the backup pad and connects the peripheral area of the backup pad proximate to the peripheral region of the sanding surface with the side of the backup pad opposite the side adjacent to the sanding surface.

The invention is also directed to a method of sanding the surface of a workpiece by using a sanding means which comprises drawing away the particles sanded free from the surface of the workpiece by applying a suction at the central area of the sanding means proximate to the surface of the workpiece, or by applying a suction at the peripheral area of the sanding means proximate to the surface of the workpiece, or by applying a suction at both the central area and the peripheral area of the sanding means proximate to the surface of the workpiece.

The invention also includes a sanding disc for use with a backup pad that has a central suction opening therein comprising a peripheral sanding surface having grit thereon and a suction opening in the centre thereof. The sanding surface can have a peripheral flexible skirt affixed thereto. The sanding surface can have one or more suction openings located therein in the peripheral area thereof and the backup pad has one or more corresponding suction openings located therein. The backup pad in association with which the sanding disc is used has at least one suction opening in the periphery thereof in addition to the central suction opening therein and the suction openings in the sanding disc correspond in position with the suction openings in the backup pad.

The invention is also directed to a suction housing for use with a sanding means. The housing permits a vacuum to be drawn on a rotating sanding means without the entry of significant casual air into the suction housing. A suction shut off control can be located in the housing. A sealing means can be provided on the suction housing to prevent the entry of a significant amount of casual air into the suction housing.

Finally, the invention includes a loader for use in affixing a sanding disc to a backup pad comprising: (a) a loader housing, (b) a vertical centering pin mounted in the centre of the loader housing, (c) a spring means positioned in association with the centering pin, and (d) a centering plate mounted on the spring means.

Finally, the invention includes a sanding disc for use with a backup pad comprising a central portion, projections extending radially from the central portion, grit distributed over the central portion and the projections, and a strong flexible member backing and reinforcing the central portion and the projections. The projections can be of greater width at their extremes than at the point where they join the perimeter of the central portion. The wider width at the extremes assists the projections in holding the disc to a backup pad because they are not as susceptible to slipping out from under the O-ring.

DRAWINGS

Figure 1:
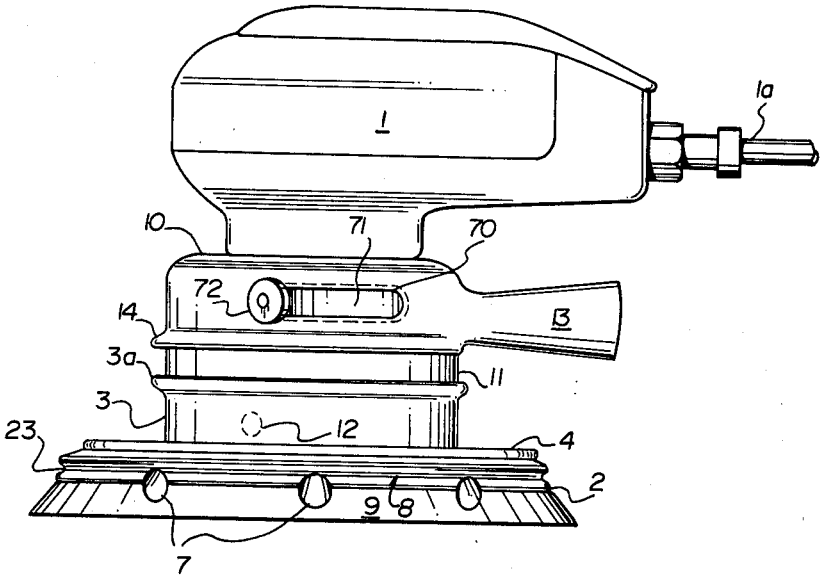
FIG. 1 is a perspective view of a pneumatic sander with a backup pad and vacuum housing attachment.
Figure 2:
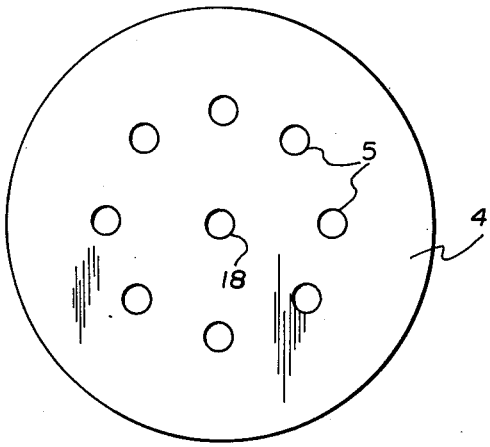
FIG. 2 is a top view of a backup pad cover.
Figure 5:
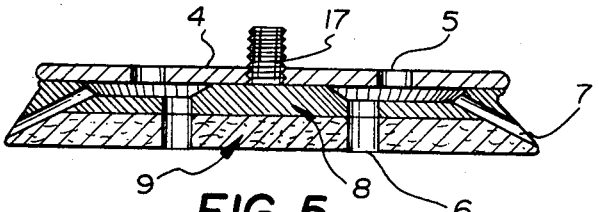
FIG. 5 is a cut-away view of the backup pad shown in FIG. 4, with the backup pad cover shown in FIG. 2.
Figure 17:
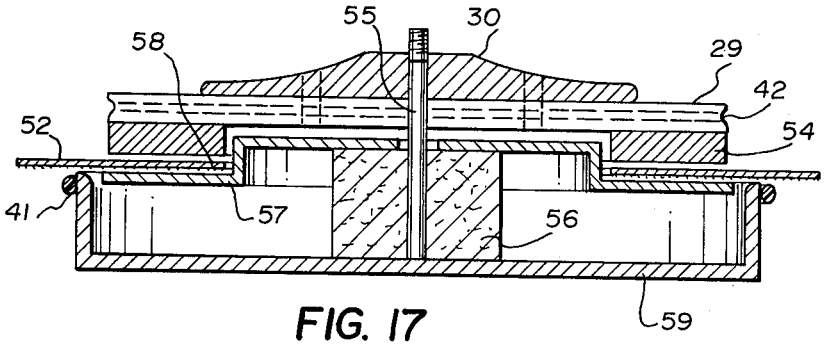
Figure 18:
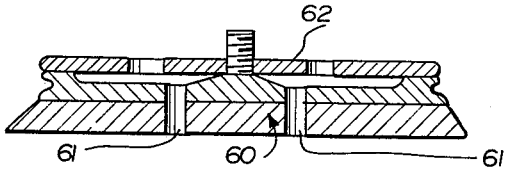
Figure 19:
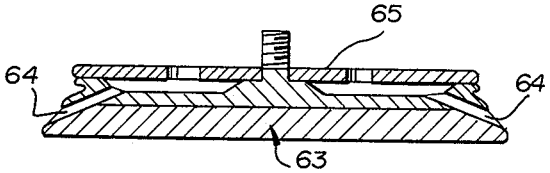
Figure 20:
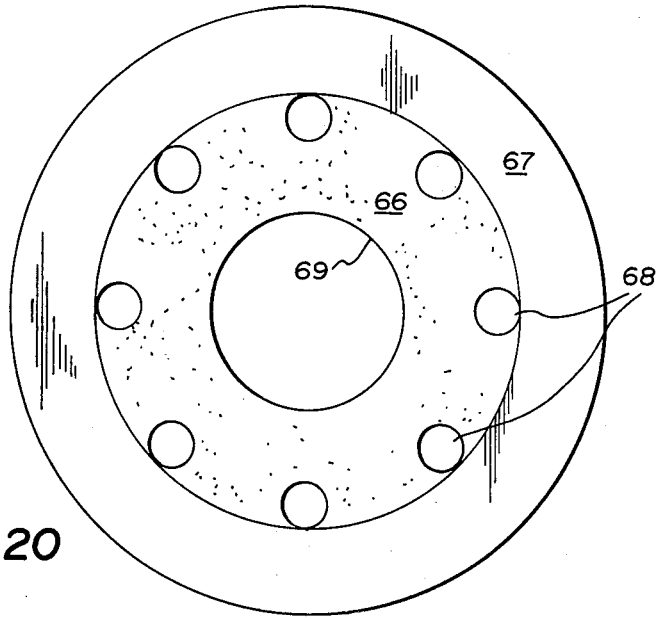

FIG. 17, which is shown on the same sheet as FIGS. 1 and 2, is a partial section view of a sanding disc loading device;

FIG. 18 is a cut-away view of a backup pad similar to FIG. 5 except only centre suction openings are shown; and FIG. 19 is a cut-away view of a backup pad similar to FIG. 18 except only peripheral suction openings are shown;

FIG. 20 is a top view of a sanding disc with a single central suction opening, and closed peripheral suction openings located in the periphery of the sanding surface.

Figure 21:
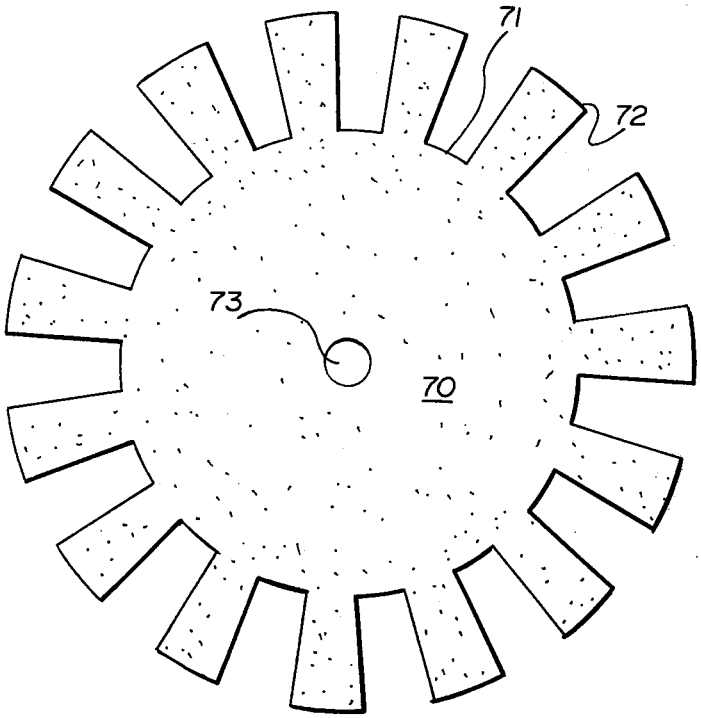
Figure 22:
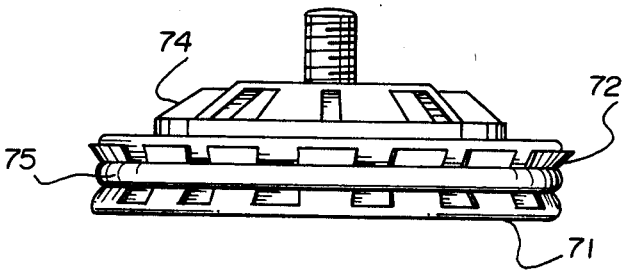

FIG. 21 is a top view of a sanding disc with a central portion and projections located around the perimeter of the central portion and extending radially therefrom; and FIG. 22 is a side view of a sanding disc as illustrated in FIG. 21 fastened to a backup pad by an O-ring.

DETAILED DESCRIPTION OF THE INVENTION

Referring to FIG. 1, a pneumatic sander 1 driven by compressed air received through compressed air line 1*a*, drives a backup pad 2, which has mounted above it a backup pad cover 4 and a suction housing 10 with suction outlet 13. FIG. 1 shows peripheral suction openings in the backup pad 2. Central suction openings in the backup pad may also be present.

The backup pad 2, is constructed of a ribbed reinforcing disc 8, which is affixed to and overlies a backup resilient pad 9. (See FIG. 3 for more details.) The resilient pad 9 can be of various degrees of softness to suit the type of sanding job that is desired. The backup pad 2 has located around its periphery one or more peripheral suction holes 7. In practice, the suction outlet 13 is connected to a vacuum source which draws a vacuum on the suction housing 10, and the overall backup pad system.

The backup pad cover 4, and the ribbed reinforcing disc 8, are normally constructed of semi-rigid slightly flexible materials, which, when flexed, tend to create an opening between the backup pad cover 4, and the bottom of the suction housing 10. To provide a suction seal, a suction sealing ring 3 is mounted around the periphery of the suction housing 10, immediately above the backup pad cover 4. The suction sealing ring 3 is usually constructed of rubber, or similar elastic material, and is cut to oversized dimensions so that there is a certain amount of slack 3*a* in the middle of the sealing ring 3. Since the sealing ring is constructed of elastic material, the slack maintains a constant downward pressure on the backup pad cover 4. To prevent the suction sealing ring 3 from riding up on the suction housing 10, a suction housing sealing ring seat 14 is located around the periphery of the suction housing 10, below the suction outlet 13. This sealing ring seat 14 can be formed in the suction housing 10, or can merely be a metal ring, or the like, fastened to the circumference of the suction housing 10. The ribbed reinforcing disc 8 has located around its circumference a peripheral groove 23, which is used for mounting a sanding disc on the backup pad by means of an O-ring as will be explained in detail later in this specification.

A suction shut off device is located on the housing 10. The device consists of a horizontal slot 70 with a suction shut off plate 71 mounted behind the plate. A knob 72 is attached to the plate 71. The plate 71 slides horizontally behind the slot 70. When the knob 72 is pulled fully forward as shown in FIG. 1, the suction housing 10 is completely closed and any vacuum drawn on the housing 10 through suction outlet 13 is transmitted to the suction holes 7. When the knob 72 is pulled back to the right hand end of the slot 70 as seen in FIG. 1, the plate 71 slides inside housing 10 and closes off suction outlet 13. It is advantageous to be able to shut off the suction when sandpaper is being changed on the backup pad 2. Otherwise, the sandpaper tends to get sucked into the suction holes 7, and can become torn or badly bent. Locating the knob 72 and plate 71 at intermediate positions along the slot 70 permits the degree of suction drawn on the suction housing 10 to be adjusted.

Referring to FIG. 2, it will be seen that backup pad cover 4 has located therein one or more backup pad cover suction openings 5, and in the centre thereof a receiving hole 18.

Figure 3:
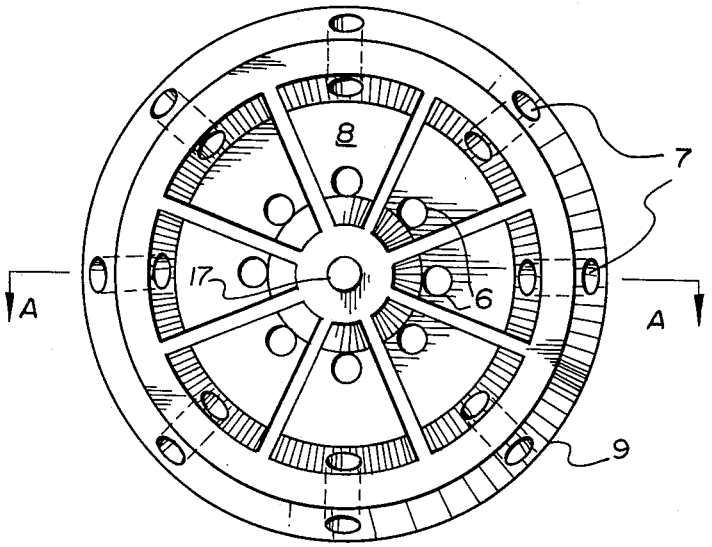
FIG. 3 is a top view of the backup pad shown in FIG. 1.

FIG. 3 shows a top view of ribbed reinforcing disc 8 and backup pad resilient pad 9, with one or more centre suction holes 6 located in the central area thereof and one or more peripheral suction holes 7 around the periphery of the backup pad. A bolt 17 is located in the centre of the ribbed reinforcing disc 8. The backup pad with both centre and peripheral suction openings provides the most efficient dust removal action. An arrangement of eight centre and eight peripheral suction openings provides good dust removal action.

Figure 4:
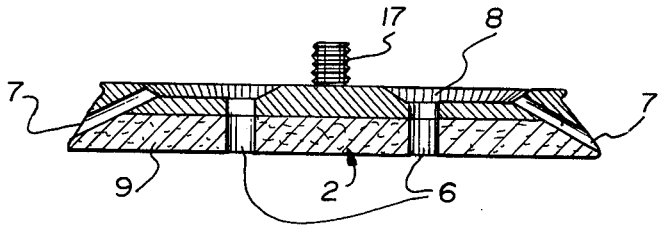
FIG. 4 is a cut-away side view of the backup pad shown in FIG. 3.

FIG. 4 shows a section view of FIG. 3, taken along section lines A—A. It can be seen that the central suction holes 6 penetrate completely through the backup pad 2. The peripheral suction holes 7 connect the top interior region of the backup pad ribbed reinforcing disc 8 with the exterior of the peripheral area of the backup pad resilient pad 9.

FIG. 5 shows a section view of the backup pad, with a backup pad cover 4 mounted above the ribbed reinforcing disc 8. The backup pad cover has suction openings 5 located therein, and the suction openings 5 communicate with both the centre suction holes 6 and the peripheral suction holes 7 of the backup pad. The backup pad with these suction openings located therein becomes in effect a rotating vacuum chamber under operating conditions.

Figure 6:
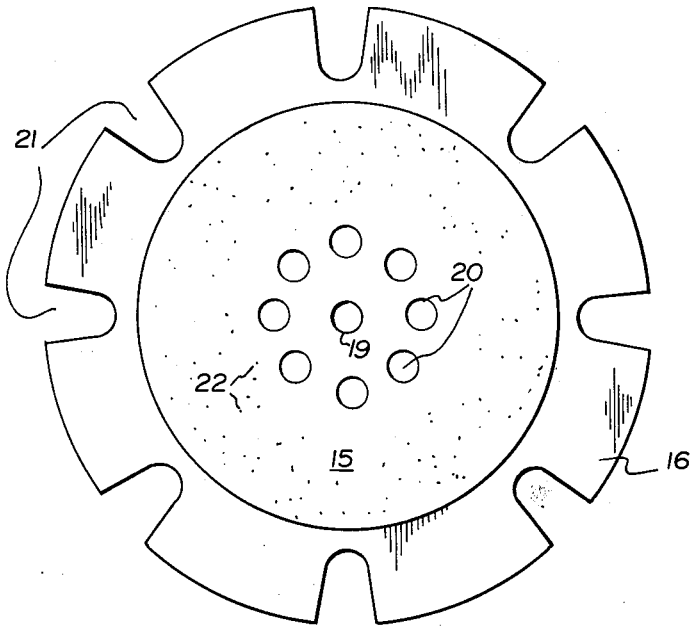
FIG. 6 is a top view of a sanding disc with peripheral flexible skirt.

FIG. 6 illustrates a sanding disc 15 that is used in association with a backup pad system which has both central and peripheral suction openings such as that disclosed in FIG. 1 to 5 inclusive. The central area of the sanding disc consists of a circular disc 15, with a peripheral flexible skirt 16 attached thereto. The central disc 15 has a plurality of suction openings 20 located in the central area. The flexible skirt 16 has a number of radially extending suction openings 21 spaced more or less equally around the circumference of the flexible skirt 16. The sanding disc 15 has abrasive grit 22 affixed to the surface of the sanding disc 15. This area is used for the actual sanding operation. No grit 22 is affixed to the flexible peripheral skirt 16. The sanding disc 15 has a centering hole 19 located in the centre thereof. This centering hole 19 is of assistance in lining up and attaching the sanding disc 15 and the flexible skirt 16, to the backup pad 2, as will be explained later in this specification.

Figure 7:
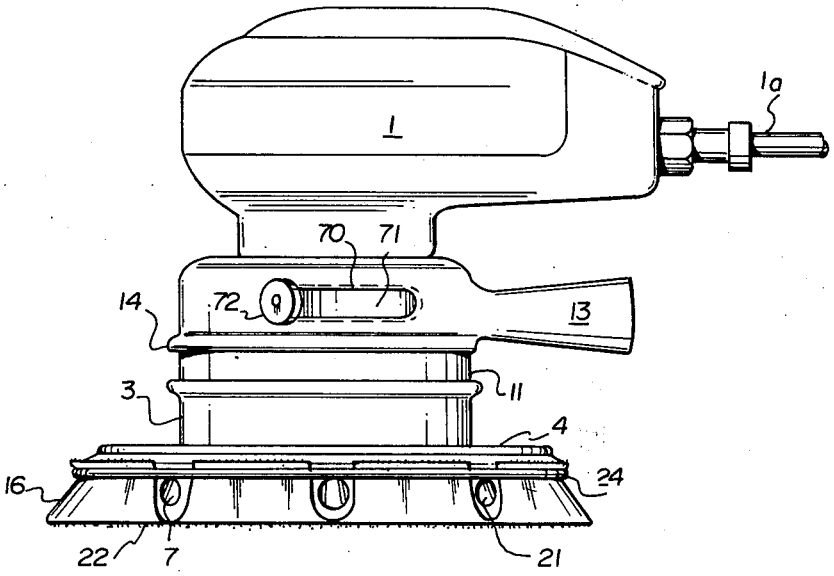
FIG. 7 is a perspective view of a sander, vacuum housing, and a backup pad with the sanding disc shown in FIG. 6 mounted on the backup pad.

FIG. 7 shows a side view of a sander 1, vacuum housing 10, and backup pad arrangement, with a sanding disc as shown in FIG. 6 fastened to the bottom and side surfaces of the backup pad. The flexible skirt 16 is folded upwardly around the sides of the backup pad so that the flexible skirt suction openings 21 coincide with the peripheral suction openings 7 of the backup pad. Thus the flexible skirt 16 does not interfere with the passage of air through the peripheral suction openings 7. The flexible skirt 16 is held against the sides of the backup pad by means of an elastic O-ring 24 which rests in the peripheral groove 23 of the reinforcing disc 8 (See FIG. 1). The sanding disc 15 is attached to the backup pad so that the grit side of the sanding disc 15 faces away from the backup pad and toward the surface of any workpiece surface that requires sanding.

Figure 8:
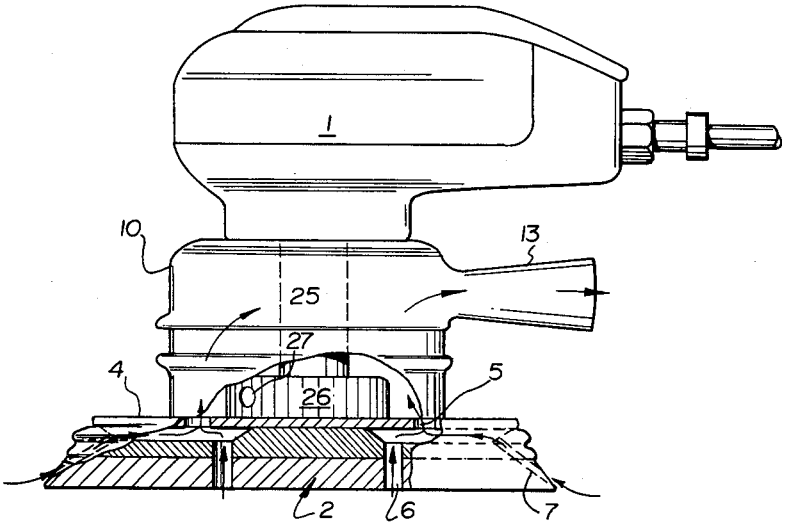
FIG. 8 is a partially cut-away view of the sander, vacuum housing, and backup pad.

FIG. 8 shows a partially cut-away view of the backup pad and suction housing combination and the air flow pattern that is created when a vacuum is applied to suction outlet 13. A vacuum at suction outlet 13 can be applied by using a two horse power industrial type vacuum cleaner, such as the portable industrial type vacuum cleaner that is manufactured under the trade mark EUREKA. This vacuum cleaner has a $1\frac{1}{4}$ inch suction hose, which is ideal for attaching to the suction outlet 13. In FIG. 8, it can be seen that air is drawn in through the centre suction holes 6, as well as the peripheral suction holes 7. The air from these two sources is then drawn through the suction holes 5 in the backup pad cover 4. The air is then collected in suction housing 10 and is exhausted through suction outlet 13. With this system of connecting the suction openings, it is possible to draw air through openings 6 and openings 7 even when the backup pad 2 is being rapidly rotated by the sander motor 1 and housing 10 remains stationary. FIG. 8 also demonstrates the manner in which the backup pad 2 is connected to the drive shaft 25 of the sander 1. The drive shaft 25 of the sander 1 has a chuck 26 at the lower end thereof. A tightening nut hole 27 is located in the chuck 26. The bolt 17 of the backup pad 2 (See FIG. 4) is screwed into chuck 26, and is then secured in place by means of tightening nut hole 27.

Figure 9:
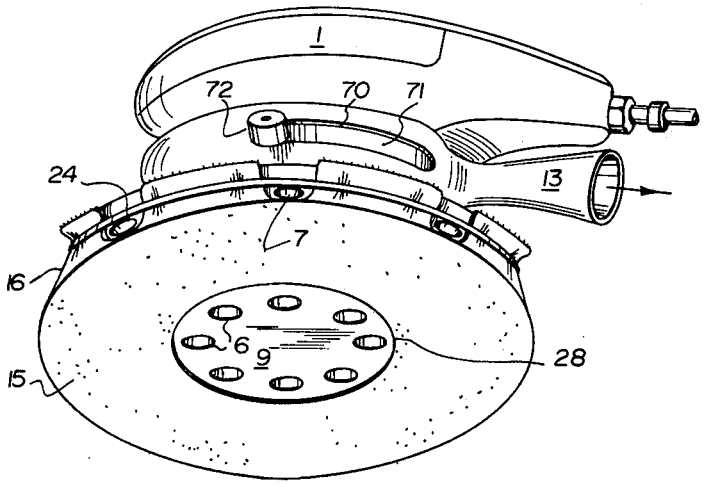
FIG. 9 is a perspective view of a sander, vacuum housing, backup pad, and a single central suction opening sanding disc mounted on the backup pad.

FIG. 9 shows an upwardly tilted perspective view of the sander 1, suction housing 10, and backup pad combination with the underside of the backup pad and the sanding disc 15 visible. Eight centre suction holes 6 are distributed evenly around the central area of the backup pad 9. These radially correspond in position with the peripheral suction holes 7. It has been found convenient to radially co-ordinate the positioning of the centre suction holes 6 and the peripheral suction holes 7 for purposes of both manufacturing and sanding disc mounting.

The sanding disc 15 as shown in FIG. 9, has only one centre suction hole 28. It differs in this respect from the sanding disc shown in FIG. 6. The sanding disc 15 shown in FIG. 6 can also be used, with the six suction openings 20 aligned in position with the six suction openings 6 in the backup pad. The flexible skirt 16 of the sanding disc 15 is secured to the backup pad by rubber O-ring 24.

Figure 10:
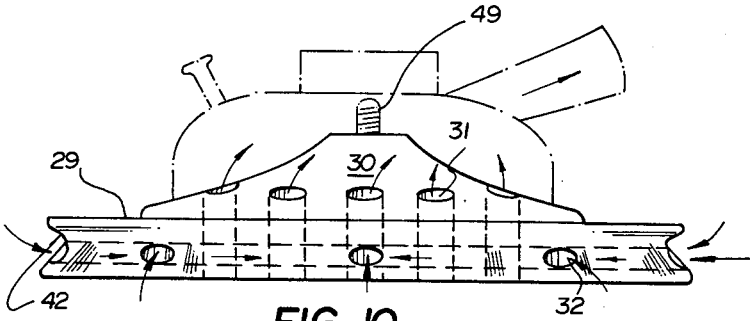
FIG. 10 is a side view of an 8 inch backup pad with reinforcing disc.

FIG. 10 shows a larger sized backup pad 29 which is known in the trade as an 8 inch backup pad. The 8 inch backup pad is constructed of a circular semi-flexible sponge-like material 29 which has mounted on the top thereof a reinforcing disc 30. The reinforcing disc 30 is manufactured of a semi-rigid material having only limited flexibility. A plurality of centre suction holes 31 extend vertically through the reinforcing disc 30, and the backup pad 29. A series of peripheral suction holes 32 can be arranged around the periphery of the backup pad 29. These peripheral suction holes 32, when present, can be joined with the centre suction holes 31 as shown by the dotted lines in FIG. 10. Thus, when peripheral openings 32 are present, a vacuum applied to the top of holes 31 will draw air in through both peripheral openings 32 and the bottom of centre openings 31. A peripheral groove 42 is built into the backup pad 29. A suction housing is shown in dotted lines in FIG. 10 overlying the reinforcing disc 30 and backup pad 29 combination.

Figure 11:
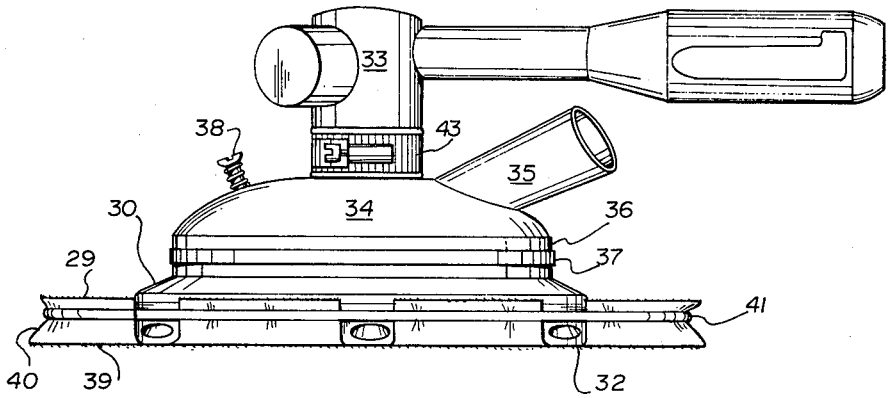
FIG. 11 is a perspective view of an 8 inch pneumatic sander, suction housing, 8 inch backup pad, and an 8 inch sanding disc mounted on the backup pad.

FIG. 11 shows an 8 inch backup pad in combination with the 8 inch suction housing 34, and an 8 inch pneumatic motor 33. The pneumatic motor is air driven by means of an air turbine which is rated at $1\frac{1}{4}$ horse power. A suitable air turbine motor can be purchased under the trade mark DOTCO and rotates the sanding disc 32 at about 1500 rpm.

The suction housing 34 consists of a suction outlet 35, and a sealing ring 36. The sealing ring is constructed of rubber, or some other suitable elastic material, and can be stiffened to withstand vacuum pull by adding a reinforcing layer of canvas, or some other suitable material. The sealing ring is held in place by a rubber band 37. The suction housing 34 and sealing ring 36 overly the reinforcing disc 30 The suction housing 34 is secured to the pneumatically driven motor 33 by means of an adjustable clamp 43.

An 8 inch sanding disc 39 is held in place on the 8 inch backup pad by means of an 8 inch flexible skirt 40, and an 8 inch O-ring 41. The openings in the flexible skirt 40 coincide with the peripheral suction holes 32 of the 8 inch backup pad, when peripheral openings 32 are present.

It has been found that in operation, when a backup pad having only central suction openings is used, and when a vacuum is applied to the suction opening 35, the 8 inch backup pad and sanding disc 39 combination is held against the workpiece with such force that it is difficult for the workman to move the 8 inch sander about the surface of the workpiece. Accordingly, in order to permit the sander to move about the workpiece by manual manipulation, it is necessary to have an adjustable suction control valve 38 located in the suction housing 34. This permits the vacuum force in the housing 34 to be adjusted so that the sander is held against the surface of the workpiece with only moderate force. When peripheral suction openings are present, the holding force against the workpiece surface is negligible and a suction control valve 38 is not necessarily required.

Figure 12:
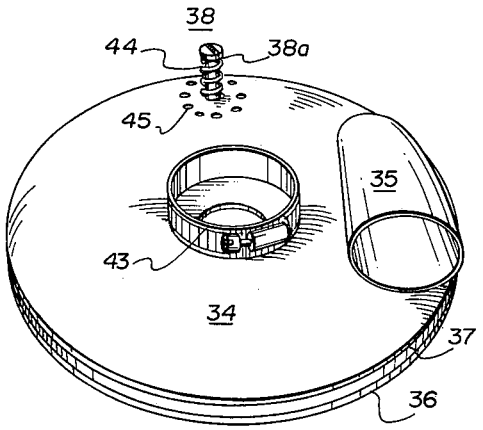
FIG. 12 is a raised dimensional view of the suction housing shown in FIG. 11.
Figure 13:
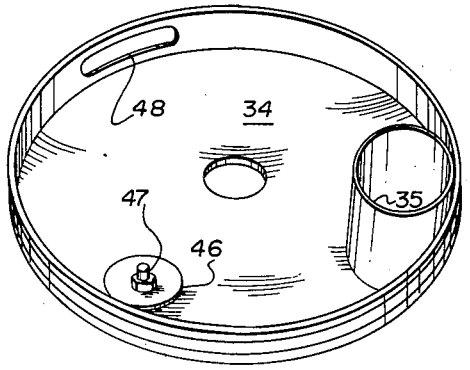
FIG. 13 is an underside perspective view of the vacuum housing shown in FIGS. 12 and 13.

FIG. 12 shows a perspective view of the suction housing 34, with the sealing ring 36 and the rubber band 37 in place. The adjustable suction control valve 38 can be constructed by using a screw bolt **38*a* that fits through the interior of a vertical coil spring 44. A series of small control valve holes 45 are punched in the suction housing 34. The underside of the suction housing 34, as shown in FIG. 13, shows the other components of the adjustable suction control valve 38. The screw bolt 38*a* fits into a control valve nut 47. The nut 47 holds a control valve disc 46 in place against the surface of the suction housing 34. In operation, when a vacuum is drawn on the interior of the suction housing 34 by means of suction outlet 35, the disc 46 is drawn inwardly against the force of the coil spring 44, thereby creating a slight opening between the disc 46 and the suction housing 34. Air is then drawn into the interior of the housing 34 through the control valve holes 45. The air drawn into the housing 34 relieves to a slight extent the suction drawn on the interior of the suction housing 34. The amount of reilef can be adjusted to the preference of the workman handling the 8 inch sander by tightening or loosening the screw bolt 38***a* and the nut 47 combination which in turn adjusts the amount of tension on the coil spring 44. The degree of tension on the coil spring 44 regulates proportionally the degree of vacuum that can be drawn on the housing 34.

FIG. 13 also shows a tightening slot 48 located in the side wall of the suction housing 34. This tightening slot 48 permits an allen wrench, or some other suitable instrument, to be inserted through the wall of the suction housing 34 in order to connect the backup pad 29 to the drive shaft of the motor 33.

Figure 14:
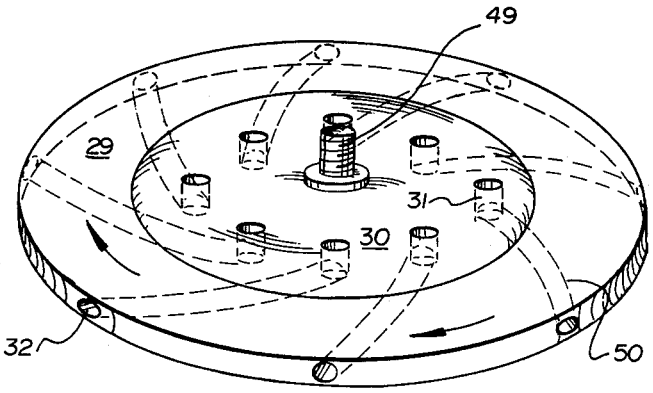
FIG. 14 is a three dimensional view of an 8 inch backup pad and reinforcing disc as shown in FIG. 10.

FIG. 14 shows a detail of the manner in which any peripheral suction holes 32 in the 8 inch backup pad are connected to the central suction holes 31. Because of the connection, the vacuum for both the peripheral suction holes 32 and the central suction holes 31 is drawn by means of the central holes 31. The peripheral suction holes 32 can be connected directly to the corresponding central suction hole 31 in a radial direction if this is desired. However, it has been found that as the backup pad 29 rotates at a speed of 1500 rpm., or thereabouts, better suction can be obtained through peripheral suction holes 32 by taking advantage of the rotational force of the backup pad 29. This is done by joining the periheral suction holes 32 with the corresponding central suction holes 31 that immediately precede the suction holes 31 that are oriented radially with the peripheral suction holes 32. This system of connection gives a "pin-wheel" appearance to the orientation of the connecting channels 50 which are shown by means of dotted lines in the backup pad 29. FIG. 14 also shows a bolt 49 which is used to connect the backup pad 29 with the motor 33 (See FIG. 11).

Figure 15:
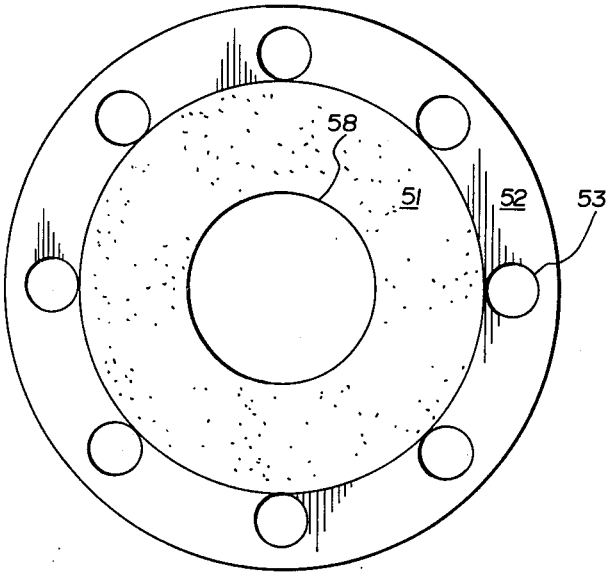
FIG. 15 is a top view of a sanding disc with a single central suction opening, and closed peripheral suction openings.

An 8 inch sanding disc having central suction openings that correspond in position with the central suction holes 31 of the backup pad 29, and peripheral suction openings in the flexible skirt corresponding in position with the peripheral suction holes 32 of the backup pad 29, can be used for the 8 inch sander. Such a sanding disc may have much the same appearance as the disc shown in FIG. 6. However, a modified version which has only a single central opening, can be used. The central opening in this version permits air to be drawn unhindered through the central suction openings 31 of the 8 inch backup pad. A further possible variation of sanding disc is shown in FIG. 15. In that variation the sanding disc 51 has a single central opening 58. However, the flexible skirt 52, rather than having elongated openings that extend radially to the peripheral extremities of the flexible skirt, such as shown in FIG. 6, has circular type openings 53. These openings 53 permit air to be drawn through the peripheral suction openings 32 of the 8 inch backup pad.

Other shapes and types of sanding disc can also be used in this invention. For example, the sanding disc can be simply a circular disc with or without a centre suction opening depending whether a similar suction opening is present in the backup pad. This shape of disc is glued directly to the bottom surface of the backup pad, in which case it is not necessary to have the flexible skirt 52. However, a disadvantage with glueing the sanding disc to the backup pad is that, with time, the glue tends to collect in and clog the central suction openings 31. Moreover the old hardened glue tends to build up on the surface of the backup pad, creating mounds and valleys, which provide an uneven wearing surface to the sanding disc, thereby shortening the life of the sanding disc.

Figure 16:
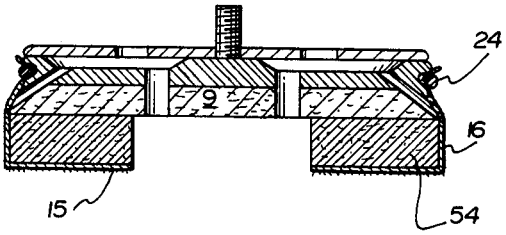
FIG. 16 is a partially cut-away side view of a backup pad with a doughnut softening pad mounted thereunder, and a sanding disc mounted on the backup pad.

Sometimes, in specialized sanding operations, it is necessary to provide extra softness to the sanding pad. This is commonly done as shown in FIG. 16 by using a "doughnut" softening pad 54. This pad 54 is constructed of a sponge-like material that has a softness suited for the application required. Such "dougnnut" softening pads 54 can easily be incorporated in the sanding system as described above. In FIG. 16, which shows a section view of the backup pad arrangement disclosed previously in FIG. 5, the softening pad 54 is shown mounted under the resilient backup pad 9. The "doughnut" softening pad 54 has a central opening, and is held in place by a sanding disc 15, which also has a single central opening. The style of sanding disc shown in FIG. 6 can also be used in this application so long as at least one suction opening is provided to enable the central suction openings of the backup pad to function properly. The sanding disc 15 is fastened to the backup pad by means of a flexible skirt 16, which is held in place by the rubber O-ring 24 as described previously.

To assist in fastening a sanding disc to a backup pad, I have invented a loader, which is shown in FIG. 17. The loader shown in FIG. 17 is adapted to fasten a sanding disc and flexible skirt 52 together with a "doughnut" softening pad 54, to an 8 inch backup pad 29, reinforced by disc 30. However, minor modifications can be made to the basic loader, in order to adapt if for smaller sizes of backup pad, with or without doughnut softening pads. In the loader shown in FIG. 17, loader housing 59, which has a generally hollowed out cylindrical shape, has positioned in the centre thereof a vertical centering pin 55. Around the centering pin 55 is located a sponge spring 56, which is constructed of a resilient spring-like material. Flexible polyurethane foam is suitable for spring 56, but a coil spring would work equally as well. Mounted on the sponge spring 56 is a centering plate 57. This centering plate 57 is shaped to accommodate a sanding disc and flexible skirt 52, having a single central opening 58, and a doughnut softening pad 54. An O-ring 41 is positioned around the circumference of the walls of the loader housing 59 as shown. The sanding disc 52, and the softening pad 54, are then placed one above the other on the centering plate 57 as shown. Then the 8 inch backup pad 29, and the reinforcing disc 30 are placed over the centering pin 55.

The flexible skirt 52 is fastened to the backup pad 29 by pushing down on the backup pad 29, softening pad 54, flexible skirt 52, and plate 57 combination, thereby depressing sponge spring 56, until the groove 42, in the circumference of the backup pad 29, is aligned with the upper edge of the loader housing 59. At this point, the rubber O-ring 41 is rolled upwardly off the loader housing 59, and snaps into place in the peripheral groove 42, thereby fastening flexible skirt 52 against the sides of the backup pad 29.

FIG. 18 shows a cut-away view of a backup pad 60 which has only centre suction openings 61. A backup pad with only centre suction openings 61 has been found to be very effective in removing dust from the workpiece, notwithstanding that a backup pad with both central and peripheral suction openings has been found to be the most effective. FIG. 18 shows the backup pad with a cover plate 62, although this can be eliminated by using a suction housing 10 (See FIG. 8) that extends to the periphery of the backup pad.

FIG. 19 shows a cut-away view of a backup pad 63 which has only peripheral suction openings 64. As with the backup pad shown in FIG. 18 having centre suction openings, a backup pad with peripheral suction openings only is very effective in removing the material abraded free from the surface of the workpiece. The suction openings 64 located around the periphery of the backup pad proximate to the surface of the workpiece, apply a suction action on the surface of the workpiece, similar to the action that is applied by my peripheral vacuum chamber attachment which is disclosed and claimed in my pending Canadian patent application Ser. No. 148,535, filed Aug. 2, 1972. The backup pad with the peripheral suction openings only has the slight disadvantage that full manual pressure must be used to hold the sander against the workpiece. While, the peripheral suction openings are effective, the preferred system is a backup pad having both central and peripheral suction openings. FIG. 19 shows a cover plate 65 but as with the centre suction opening backup pad shown in FIG. 18, the cover plate 65 can be eliminated by using a suction housing that extends to the periphery of the backup pad.

FIG. 20 shows a sanding disc 66 with a single central suction hole 69, a flexible skirt 67, and a series of peripheral suction holes 68 located in the periphery of the sanding disc area 66, and not in the peripheral flexible skirt 67, as shown in FIG. 6 or FIG. 15. This type of sanding disc is intended for use with a backup pad that has peripheral suction openings located in the peripheral underside area of the backup pad rather than in the vertical sides of the backup pad as shown, for example, in FIGS. 1, 4, 5 and 7. One slight problem with having peripheral suction openings 68 located in the actual sanding area of the disc 66 is that sometimes the openings become caught in sharp projections on the workpiece and the disc becomes torn. However, sometimes it is advantageous to have the suction openings 68 on the underside periphery of the sanding disc 66 in order to obtain better suction action.

FIG. 21 shows a sanding disc 70 consisting of a circular centre portion 71 with a plurality of radially extending projections 72 located around the periphery of the centre portion 21. A centering hole 73 is located in the middle of the centre portion 71. The projections 72 are wider at their extremes than at the point where they join the centre portion 71. This makes the projections 72 less susceptible to slipping out from under the O-ring when the disc 70 is fastened to a backup pad by an O-ring.

A reinforcing backing means (not shown) is secured by glue or other suitable means to the back of the centre portion 71 and the projections 72. The backing means makes the sanding disc 70 more rugged and resistant to tearing.

FIG. 22 shows the sanding disc centre portion 71 and projections 72, as illustrated in FIG. 21, secured to a backup pad 74 by means of an O-ring 75. Grit is on the surface of the centre portion 71 as well as on the projections 72 and this assists in enabling the O-ring to hold the sanding disc on the backup pad 73. It will be noted that the edges of the centre portion 71 curl up slightly around the edges of the backup pad 74 so that no sharp edge, which can cause scratches and marks, occurs at the edge of the pad. effectiveness of my sanding system having suction openings in the backup pad and the sanding disc.

EXAMPLE 1

A hood of a 1965 Ford automobile, painted with two coats of primer and four coats of green acrylic enamel was sanded using a five inch sanding pad and disc, 120 grit grade, driven by an Oribital air driven sanding motor, at a rotation of 8,000 rpm.

The Oribital sander was manufactured by Hutchins Manufacturing Company, Pasedena, California. The 120 grit grade sandpaper is commonly used in sanding operations in automobile assembly plants. The vacuum machine used to draw the suction action on the backup pad was a two horsepower portable industrial type vacuum cleaner sold under the trade mark EUREKA. The vacuum hose was approximately 1¼ inch in diameter.

The backup pad and sanding disc both had eight centre openings and eight peripheral suction openings located in the sides of the backup pad and the flexible skirt of the sanding disc. The central suction holes in the backup pad drew in loose material through the centre hole in the sponge ring, while the peripheral suction holes located about the periphery of the bckup pad drew in any dust that escaped the edges of the rotating sanding disc.

The suction action drawn on the sander through the central suction holes was of assistance in holding the sander and the sanding disc down onto the hood so that it was easy to control the movement of the sander by hand.

By using this sanding system, it was possible to easily sand away a good area of the four coats of enamel and the two coats of primer on the hood in a relatively short time. However, the startling attribute about the sander was that virtually no dust escaped being collected by the system of suction openings in the backup pad of the sander. This was true, even when the edges of the hood were being sanded so that a certain portion of the sanding disc extended over the edge of the hood. Nevertheless, any dust generated was visible to the eye for only a moment before being sucked into one of the suction openings in the backup pad. Another startling feature about the sander was that virtually no dust remained adhered to the hood due to electrostatic attraction. It was possible to run a finger along the sanded surface of the hood, and almost no visible dust was picked up on the finger, even though the paint being abraded away by the sanding device was of a dark green colour.

A hose with 150 pounds of air pressure was held close to the surface of the hood but it was not possible to blow away any more dust. The slight amount of dust that was present on the hood could be removed with a polishing cloth.

The sanding disc on the backup pad could be removed readily from the backup pad by shutting off the suction to the housing by moving the shut-off knob on the side of the housing to the back and then removing the sanding disc and replacing it with a fresh sanding disc.

EXAMPLE 2

The sand sanding device was used as described above in Example 1. However, for this demonstration, the vacuum cleaner was disconnected and no vacuum was applied to the backup pad. The results were startling. In a matter of 15 to 30 seconds, a considerable amount of dust was generated by the sanding disc. Mounds of dust were left on the surface of the car hood. Moreover, a considerable quantity of dust began to float in the air and made working conditions very uncomfortable because one could not avoid inhaling some of the dust. Other dust floating in the air settled on the hands and clothing of anyone standing within ten to fifteen feet of the demonstration. If the demonstration had continued for a substantial length of time, the amount of dust generated would have been virtually impossible to deal with.

EXAMPLE 3

Another portion of the 1965 Ford car hood mentioned in Example 1 was sanded using an 8 inch sanding disc, driven by a $1\frac{1}{4}$ inch horsepower air turbine motor manufactured by Dotco. The sanding disc was 120 grit grade. A sponge ring was mounted between the backup pad of the 8 inch backup pad, and the 8 inch sanding disc. The backup pad had only central suction openings. The centre hole in the sanding disc was five inches in diameter. The sanding disc was driven at 1500 rpm.

Using the two horsepower EUREKA type vacuum cleaner, it was possible to readily sand the green paint from the hood of the car using only reasonable manual force to move the sander about the surface of the hood. The sanding disc moved easily about the surface of the car hood and no undue amount of hand pressure was required to hold the sanding disc against the surface of the car hood. Moreover, virtually no dust was left on the surface of the car hood, and virtually no dust entered into the atmosphere.

EXAMPLE 4

The same demonstration as described in Example 3 above was conducted, except that the $1\frac{1}{4}$ inch vacuum hose of the EUREKA vacuum machine was disconnected from the suction housing of the 8 inch sander. Startling differences in performance were immediately apparent. The operator had to exert about 10 pounds hand pressure in order to hold the sanding disc against the surface of the car hood. Moreover, considerable force was required to move the sanding disc about the surface of the car hood. Within 15 to 30 seconds, a considerable amount of dust was created, which left mounds of dust on the surface of the car hood, and also was discharged into the air and remained suspended for a long period of time.

EXAMPLE 5

A rectangular piece of particle board (chipboard) approximately $\frac{1}{2}$ inch in thickness, and measuring 18 inches by 30 inches, was sanded using a 5 inch sander with 220 grit grade sandpaper. The backup pad had both central and peripheral suction openings. Plastic "sawdust" produced by cutting a piece of plastic sold under the trade mark NYLON, was sprinkled around the edges of the particle board and extended approximately 2 to 4 inches away from the edges of the particle board. With the vacuum machine turned on, approximately $\frac{1}{8}$ of an inch of the particle board was sanded away at one side in about 50 to 60 seconds. However, virtually all of the sawdust generated by the rotating 5 inch sanding disc was quickly drawn away by the vacuum action of the backup pad. Moreover, the plastic "sawdust" sprinkled around the edges of the particle board was sucked up by the suction action of the backup from two to four inches away from the edges of the backup pad and sanding disc.

EXAMPLE 6

The same particle board as described in Example 5 was used in this demonstration. However, the 8 inch sanding disc driven by the Dotco air motor that was used in Example 3 was used in place of the 5 inch sander. The sandpaper was of 16 grit grade. No vacuum was drawn on the suction outlet of the 8 inch sander. Within 15 seconds, approximately $\frac{3}{4}$ of a cup of coarse sawdust was generated by the sander. This sawdust was left on the surface and around the edges of the particle board.

The vacuum hose was then connected to the 8 inch sander and the $\frac{3}{4}$ of a cup of coarse sawdust was sucked up by the suction openings in the backup pad within a few seconds. Moreover, when the edges of the particle board were sanded by the 8 inch sander, and even when as much as 4 inches of the sanding disc overhung the edge of the particle board, none of the coarse sawdust being generated by the rotating sanding disc escaped the suction action of the various suction openings in the backup pad. Coarse sawdust would be seen to fly about one or two inches away from the edge of the sanding disc, but then it would be overtaken by the suction action of the sander and would be sucked up into one of the openings in the backup pad.

The other characteristic of this test was that when no vacuum was applied to the sander, about ten pounds of hand pressure was required to hold the 8 inch sander against the surface of the particle board. In addition, substantial force was required to move the 8 inch sander about the surface of the particle board. However, with the vacuum turned on, only reasonable manual pressure was required to hold the 8 inch sander against the surface of the particle board, and move the 8 inch sander about the surface of the particle board.

EXAMPLE 7

The same Ford automobile hood and sanding system that was described in Example 1 was repeated using a backup pad with only central suction openings.

The suction action drawn on the sander by the central suction openings held the sander and sanding disc down onto the hood to such an extent that it was possible to control the movement of the sander using only the fingertips. This sanding system made it possible to sand away a substantial area of the four coats of enamel and the two coats of primer on the hood in a relatively short time. Even with only central suction openings in the backup pad virtually no dust escaped being collected by the system of central suction openings in the backup pad of the sander. This was true, even when the edges of the hood were being sanded so that a certain portion of the sanding disc extended over the edge of the hood. Any dust that was generated was visible to the eye for only a moment before being sucked into one of the central suction openings in the backup pad. Little dust remained adhered to the hood due to electrostatic attraction, although the amount remaining was greater than in Example 1. Running a finger along the sanded surface of the hood, picked up only a slight quantity of dust on the finger.

EXAMPLE 8

Another portion of the 1965 Ford car hood mentioned in Example 1 was sanded using an 8 inch sanding disc, driven by a $1\frac{1}{4}$ horsepower air turbine motor manufactured by Dotco. The backup pad had both central and peripheral suction openings. The sanding disc was 120 grit grade. A sponge ring was mounted between the backup pad of the 8 inch backup pad, and the 8 inch sanding disc. The centre hole in the sanding disc was five inches in diameter. The sanding disc was driven at 1500 rpm.

Using the two horsepower EUREKA type vacuum cleaner, it was possible to sand the green paint from the hood but full manual pressure of about 10 pounds had to be used to move the sander about the surface of the hood. The suction action developed by the central and peripheral holes was effective in removing virtually all of the dust generated by the rotating sanding disc. However, a certain amount of dust remained clinging to the hood presumably by electrostatic attraction.

EXAMPLE 9

A further portion of the 1965 Ford car hood mentioned in Example 1 was sanded using an 8 inch sanding disc, driven by a 1¼ horsepower air turbine motor manufactured by Dotco. The suction housing of the 8 inch sander had a suction control valve therein. The sanding disc was 120 grit grade. A sponge ring was mounted between the backup pad of the 8 inch backup pad, and the 8 inch sanding disc. The backup pad had only central suction openings. The centre hole in the sanding disc was five inches in diameter. The sanding disc was driven at 1500 rpm.

Using the two horsepower EUREKA type vacuum cleaner, it was possible to readily sand the green paint from the hood of the car using only two fingers. The sanding disc controlled by the two fingers moved easily about the surface of the car hood and little hand pressure was required to hold the sanding disc against the surface of the car hood. Moreover, virtually no dust was left on the surface of the car hood, and virtually no dust escaped into the atmosphere.

EXAMPLE 10

The same sanding device as described above in Example 1 was used. However, the rubber sealing ring located between the suction housing and the backup pad was lifted up. Immediately, casual air was taken into the suction system and the suction openings in the backup pad and sanding disc were rendered ineffective in drawing away the dust that was being generated by the rapidly rotating sanding disc. This demonstration revealed the great importance of having a good seal between the stationary suction housing and the rotating backup pad.

In considering the foregoing, it will be appreciated that other non-inventive embodiments and modifications of my basic sanding system can be made, all of which will nevertheless fall within the spirit of my basic invention. For example, my system of a suction housing together with a backup pad and sanding disc with suction openings and channels therein can be used not only with a rotating backup pad but also vibrating, multi-action, and oscillating backup pads so long as a good suction seal is made between the suction housing and the moving backup pad. Accordingly, all such non-inventive equivalents and modifications are to be considered to fall within the scope of my invention, as defined in the following claims.

The embodiments of the invention in which an exclusive property or privilege is claimed are defined as follows:

1. A vacuum sanding apparatus comprising in combination, a disc shaped backup pad for connection to driving means and having an abrasive sanding disc detachably secured thereto, a vacuum housing mounted on the upper surface of the backup pad; a plurality of apertures in the operative surface of the abrasive disc and being in registry with apertures in the bottom surface of the backup pad, all said apertures being in communication with the interior of said vacuum housing; means on the housing for adjusting the amount of vacuum created therein; said housing being connectable to the driving means and being adapted to receive the same centrally in the housing; and a resilient collar intermediate the peripheral lower edge of the housing and the upper surface of the backup pad whereby the housing may flex relative to the plane of the backup pad.

2. Apparatus according to claim 1 wherein the diameter of the housing is less than that of the backup pad; said housing including an outlet for connection to vacuum means, the vacuum adjusting means comprising a plate member on the inner wall of the housing and slidable between an inoperative position in which the outlet is uncovered and an operative position in which the outlet is covered.

3. Apparatus according to claim 2, including a slot in the sidewall of the housing and an arm projection from the plate outwardly through the slot for manual adjustment of the vacuum.

4. Apparatus according to claim 1 wherein the vacuum adjusting means comprises a plurality of concentrated perforations in the wall of said housing and an adjustable spring loaded plate covering said perforations.

5. Apparatus according to claim 1 wherein the backup pad comprises a relatively soft and resilient lower section bonded to a relatively hard and stiff upper section and a hard cover overlying the upper section and positioned intermediate the pad upper section and the lower peripheral edge of the housing.

6. Apparatus according to claim 5 wherein the upper section of the pad includes a plurality of radially extending ribs, one between each aperture in the pad, each pair of ribs defining between them an interior vacuum chamber enclosed by said cover; and a plurality of apertures in the outer sidewall of the pad, and extending into said chambers, the outer sidewall aperture being smaller in diameter than the apertures in the bottom surface of the pad.

7. Apparatus according to claim 1 wherein the abrasive disc comprises an abrasive central portion equal in diameter to the bottom of the backup pad and a peripheral flexible skirt extending beyond the outer edge of the abrasive portion and adapted to extend up over the sidewall of the pad; and a plurality of openings in said skirt in registry with the aperture in the sidewall of the backup pad.

8. A vacuum housing for use on a vacuum sanding device of the type driving a backup pad with an abrasive disc thereon, said housing comprising:

a. a cylindrical body portion having a central aperture in the top thereof for passage of the sanding device driving means;

b. an outlet for connection to vacuum applying means;

c. a peripheral, resilient collar on the lower end of the body portion for flexible engagement with the upper surface of the backup pad; and d. means on the body portion for adjusting the amount of air going through said vacuum outlet.

9. A housing according to claim 8 wherein the air adjusting means comprises a plate member on the inner wall of the body portion and slidable between open and closed positions over the outlet; a slot in said sidewall and an arm connected to said plate and projecting through said slot for manual adjustment of the plate.

10. A housing according to claim 8 wherein the air adjusting means comprises a plurality of concentrated perforations in the wall of the housing and an adjustable spring loaded plate covering the perforations on the inside of said housing.

11. A disc shaped backup pad for use in a vacuum sanding device, said pad comprising:

a. upper and lower portions with a first group of apertures extending upwardly through the pad normal thereto;

b. said lower portion being a soft, resilient material adapted to conform to work surfaces;

c. said upper portion being bonded to said lower portion and being of relatively firm material;

d. the outer periphery of said pad tapering inwardly and upwardly and including a peripheral groove for receiving a resilient snap ring therein;

e. said firm upper portion including a central boss for connection, a driving means and a plurality of ribs extending radially outwardly from the boss to an upstanding peripheral lip defining with said radial ribs, a plurality of vacuum chambers;

f. each of said first group of normally extending apertures terminating at its upper end in one of said chambers; and g. a plurality of apertures in the tapered side wall, each extending inwardly to terminate in one of said chambers.

12. A backup pad according to claim 11 and a cover concentrically positioned over the upper surface of said pad to enclose the top of said chambers, and a plurality of apertures in said cover in registry with said chambers.

13. An abrasive disc for mounting on a backup pad of a vacuum sander, said disc comprising an abrasive central portion and a concentric, flexible skirt, larger in diameter than said abrasive central portion for connection to the sidewall of said backup pad; a plurality of apertures in the abrasive central portion for registry with like apertures in the bottom of said backup pad; and a plurality of openings in the flexible skirt for registry with apertures in the sidewall of the pad when the skirt is secured thereon.

14. An abrasive sanding disc according to claim 13 comprising a central portion equal in diameter to the supporting surface of the backup pad and projections extending radially from the central portion, grit distributed over the central portion and the projections, and a strong flexible member backing and reinforcing the central portion and the projections; said projections being greater in width at their extreme ends than they are at the perimeter of the central portion.

15. A loader for use in affixing an abrasive sanding disc to a backup pad of a vacuum sander comprising a. a loader housing of circular configuration having a bottom wall and a peripheral sidewall;

b. a vertical centering pin mounted in the centre of the bottom wall of the loader housing, c. a spring means concentrically positioned in association with the centering pin, and d. a centering plate mounted on the spring means and having a surface contour conforming the surface contour of the bottom of a pad and paper being loader therein.

* * * * *